US005101513A

United States Patent [19]

Bowers

[11] Patent Number: 5,101,513

[45] Date of Patent: Apr. 7, 1992

[54] FOUL WEATHER APPAREL

[76] Inventor: Loren E. Bowers, 591 E. Telegraph Rd., Fillmore, Calif. 93015

[21] Appl. No.: 609,431

[22] Filed: Nov. 5, 1990

[51] Int. Cl.[5] ..... A41D 3/04

[52] U.S. Cl. ..... 2/84; 2/69; 2/69.5; 2/85; 2/87; 2/82; 2/93; 2/89; 2/216; 2/DIG. 5

[58] Field of Search ..... 2/84, 69, 82, 87, 216, 2/DIG. 5, 69.5, 85, 93, 89

[56] References Cited

U.S. PATENT DOCUMENTS

| | | | |
|---|---|---|---|
| 582,639 | 5/1897 | Gray | 2/89 |
| 601,894 | 4/1898 | Irwin | 2/89 |
| 1,599,798 | 9/1926 | Stockton | 2/89 |
| 2,118,196 | 5/1938 | Harrison | 2/DIG. 5 |
| 2,139,579 | 12/1938 | Dier | 2/84 |
| 2,344,379 | 3/1944 | Wallin | 2/89 |
| 2,376,284 | 5/1945 | Sidelmann | 2/89 |
| 2,412,415 | 12/1946 | Navon | 2/DIG. 5 |
| 3,258,781 | 7/1966 | Klein | 2/88 |
| 3,288,157 | 11/1966 | Szkolny | 2/69 |
| 3,523,302 | 11/1970 | Rabedeaux | 2/69.5 |
| 3,837,006 | 9/1974 | Laseman | 2/89 |
| 4,142,254 | 3/1979 | Arnold | 2/84 |
| 4,241,721 | 12/1980 | Holly | 2/69 |

FOREIGN PATENT DOCUMENTS

| | | | |
|---|---|---|---|
| 1133679 | 4/1957 | France | 2/89 |
| 1193 | of 1898 | United Kingdom | 2/DIG. 5 |
| 1249978 | 10/1971 | United Kingdom | 2/84 |

*Primary Examiner*—Werner H. Schroeder
*Assistant Examiner*—Gloria Hale
*Attorney, Agent, or Firm*—Lyon & Lyon

[57] ABSTRACT

A foul weather apparel to be worn by a person in which a tubular enclosure is maintained in a substantially cylindrical shape by flexible hoops at the upper and lower extremities of the enclosure and a circular panel at the top of the tubular enclosure rests on the person's shoulders to support the tubular enclosure and circular hoops. A hood is affixed to the circular panel for covering the person's head and a zipper closed radial slit in the circular panel provides convenient installation and removal of the apparel.

18 Claims, 1 Drawing Sheet

FOUL WEATHER APPAREL

This invention relates to apparel to be worn by a person in foul weather, such as rain, sleet, snow, wind or cold, for protecting the person from the foul weather elements without inhibiting that person's body movements.

From at least the beginning of history, man has attempted to devise garments to protect himself from various undesirable weather conditions with such garments having varying degrees of success. Most rain coats are satisfactory in moderately bad weather while a person stands upright but the person's head remains unprotected. Moreover, with a rain coat a person's arms are outside of the body portion of the coat and enclosed in sleeves whereby access to the inside of the coat, for example, for reaching one's pants pockets for a wallet, is greatly inhibited.

While rain capes, such as disclosed in U.S. Pat. No. 3,258,781, have been developed that combine a hood and a cape loosely fitting over the outside of the person's normal garments, whereby the head is protected from weather elements and the person's arms are more freely usable under the cape, there are some disadvantages in such capes. For example, the cape tends to cling to the body and therefore the hand and arm motion of the person is inhibited and an uncomfortable feeling of confinement can develop. Moreover, the entire weight of the rain cape, which may be considerable when wet, is supported on the person's head.

In many desirable uses for foul weather apparel, such as for a spectator at an outdoor sporting event or a hunter, the person must be able to comfortably stand or sit and move between those positions comfortably and without any loss of protection from the weather elements. Further, it is undesirable for any such foul weather apparel to adversely interfere with persons in the immediate area as, for example, an umbrella interferes with the vision of a sports event spectator sitting behind that umbrella.

It is an object of the present invention to provide a foul weather apparel that provides excellent protection from rain, sleet, snow, wind, cold or the like without most if not all of the disadvantages of prior rain coats, rain capes, umbrellas and the like.

Specifically, it is an object of this invention to provide a foul weather garment or apparel that combines a hood with a circular shoulder-supported panel that is joined to a tubular enclosure maintained in a substantially circular condition by flexible hoops at the top and bottom of the tubular enclosure, all formed of a weather-resistant material, for protecting the wearer from the particular foul weather.

Other and more detailed objects and advantages of this invention will appear from the following description and the accompanying drawings, wherein.

Figure 1:
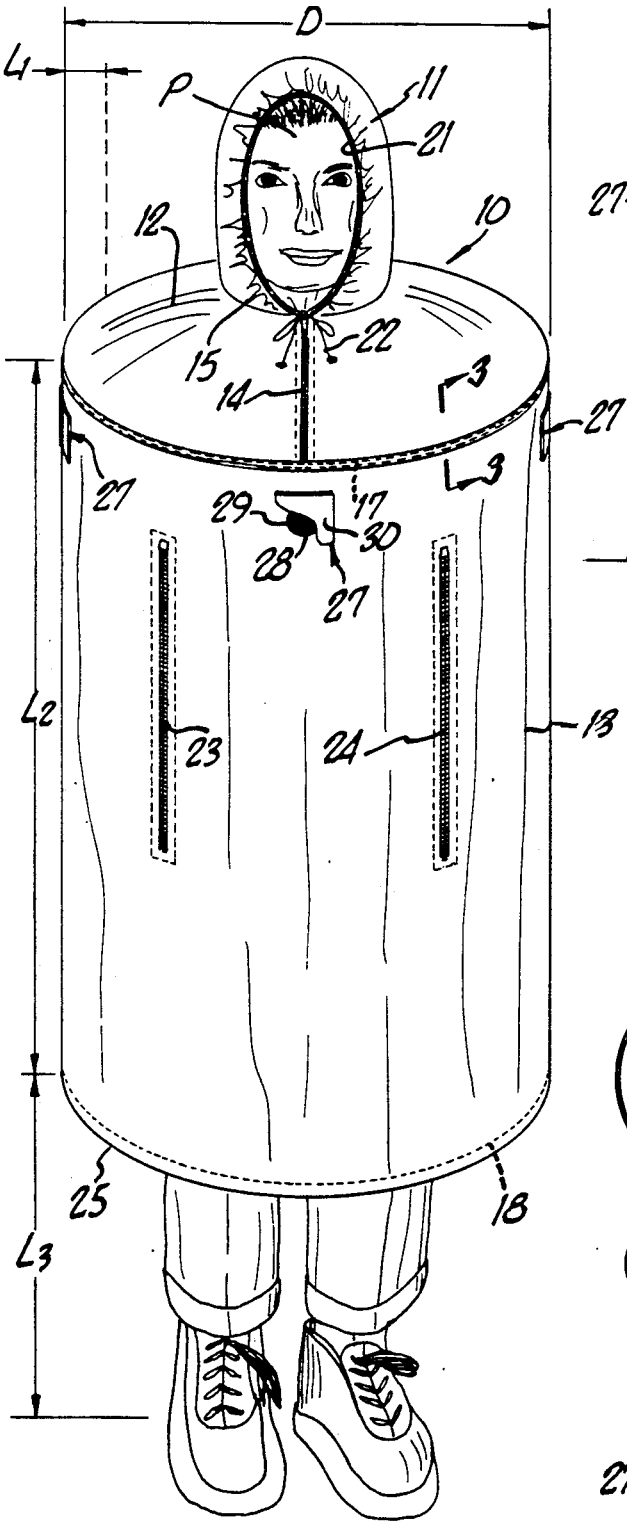
FIG. 1 is a perspective view of a person wearing the foul weather apparel of the present invention in a standing position.

The foul weather apparel or garment, generally designated 10, of this invention is comprised of a hood portion 11, a circular panel 12 and a tubular enclosure 13 all made of any desirable material for withstanding the particular weather conditions for which the garment 10 might be worn by that person. It is anticipated that for most uses a high quality water-resistant or water-proof nylon or other fabric will be satisfactory but other materials may be used for specific conditions. For example, an insulated but thin material comprised of several layers of different fabrics and sheets may be desirable in extremely cold weather conditions. On the other hand, for extremely hot and sunny conditions, a thin reflective metal foil or metallic coated Mylar film may be useful for protection against the sun and perhaps wind. Moreover, for protection from poisonous gases or nuclear radiation, still other appropriate fabrics or films may be used. Thus, for purposes of this patent application, all such fabrics, sheets, films, layers and the like that may be useful for resisting a particular foul weather or ambient condition will be referred to herein as a "weather-resistant material". The aforementioned hood 11, circular panel 12 and tubular enclosure 13 are comprised of one or more weather resistant-materials.

Figure 3:
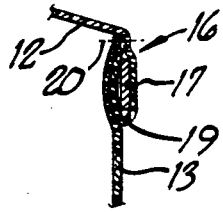
FIG. 3 is an enlarged sectional elevation view taken substantially on the line III—III as shown in FIG. 1.

The circular panel 12 is preferably of a substantially circular shape when in a flat condition and includes a radial split that is selectively openable or closable by any form of conventional closure means such as Velcro or a zipper 14. Preferably, the zipper 14 is provided with handles or tabs on both sides so that the zipper may be manipulated from either the inside or the outside. The central portion of the circular panel 12 has a hole 15 for accommodating the head and neck of the person P. The outer circumference of the circular panel 12 is substantially circular and is joined to the upper extremity of the tubular enclosure 13 by a seam, generally designated 16. The seam 16 may be formed in any conventional manner for enclosing a circular hoop 17 of a resiliently flexible material, such as steel, plastic, fiber glass or the like, having a flat or band shape, as shown in FIG. 3, with a width substantially larger than the thickness. A hoop 17 of ABS plastic 0.500" width by 0.100" thickness has been found to be satisfactory but other materials and dimensions may also be acceptable. The hoop 17 is preferably a continuous circle or has its ends permanently fixed to each other to form a substantially circular member for shaping and reinforcing the apparel 10. A similar circular hoop 18 is provided at the lower end of the tubular enclosure 13 and preferably the hoops 17 and 18 are of approximately the same size. The upper and lower hoops or frames 17 and 18, respectively, are each enclosed in a continuous pocket 19 formed of the flexible weather-resistant material. For example, as shown in FIG. 3, the material of circular panel 12 is folded around the circular frame 17 to form the pocket 19 and the material of tubular enclosure 13 overlaps and is connected to circular panel 12 by a stitching 20 on the inside of the hoop for maximum weather resistance of the seam. The pocket 19 loosely fits on the hoop 17 to allow some degree of flexible movement.

The hood 11 is joined to the circular panel 12 in a conventional manner, such as stitching, around the opening 15. The hood 11 is provided with a front opening 21 for exposing the face of the person P and a drawstring 22 may be provided in a seam or pocket surrounding the opening 21 for adjusting the size of the opening 21 to accommodate the face of the person and the particular weather conditions. Hood 11 is preferably of a sufficiently large size, particularly in the vertical direction, so as to loosely fit the head and face of any person P without providing any support for the weight of the circular panel 12 and tubular enclosure 13 portions of the apparel, which support will be described below. In other words, the foul weather apparel 10 does not hang on the person from the hood 11 as occurs with many rain cape type devices that rely on the top of the hood engaging the top of the person's head for supporting the entire garment.

For the most desirable use characteristics and results, the foul weather apparel 10 is constructed in a size to fit the particular person P although each size will accommodate people within a range of sizes, such as small, medium, large and extra large for adults and a similar set of sizes for children. Preferably, the diameter D of the tubular enclosure 13 as shaped into a circle by the circular hoop or frame 17 is approximately four inches larger than the shoulder width of the person P which provides a spacing L1 between the shoulder of the person P and the tubular enclosure 13, as well as the circular hoop or frame 17, of approximately two inches on each side of the person. Thus, the circular panel 12 rests on the shoulders of the person P which in turn supports the tubular enclosure 13 in the most desirable size, rather than allowing the circular hoop or frame 17 to rest directly on the person's shoulder which may cause some discomfort to the shoulder after extended use. The two inch spacing allows for substantial freedom of movement of the person's arms and hands within the tubular enclosure 13 and yet the extra two inches on each side of the apparel 10 does not make it objectionably large or cumbersome. Moreover, the two inch spacing on each side and the even larger spacing from the person's body in the front and back of a normally shaped person, provides an insulating air space around the entire person at least in the standing position which is very effective for keeping the person's body heat inside the apparel 10 as compared to a coat or cape that clings to the person.

The length L2 of the tubular enclosure 13 is preferably selected on the basis of the height of the person P from the ground to the person's shoulders to provide a desirable length for the type of foul weather to be encountered. Preferably, the length L2 should be such as to provide a space L3 between the bottom of the tubular enclosure 13 and the ground, when the person is standing, of approximately six inches for a small child to perhaps 12 inches for an adult to provide maximum protection. A shorter length L2 may be used for greater mobility in less severe weather conditions. Moreover, a detachable flap may be provided for extending downwardly, even to the ground, when more protection is desired.

Vertical openings 23 and 24 may be provided in the sides or in the front of the tubular enclosure 13 near the sides with closure means, such as Velcro or zippers, in those openings for the person P to conveniently extend his or her arms through the openings, as desired. Preferably, if zippers are used on the openings 23 and 24, the zippers are provided with handles on both the inside and the outside for conveniently manipulating the zippers.

Vents may be provided in the apparel 10 to allow body moisture and heat to escape and, as shown in FIG. 1, a plurality of vents, generally designated 27, may be provided in the tubular enclosure 13 in circumferentially spaced relationship and located near the top hoop 17. Each vent 27 may comprise a hole 28 through the weather-resistant material, a screen or mesh cover 29 over the hole 28, and a flap 30 attached to the enclosure 13 above the hole 28 and extending downwardly over the hole 28, which allows moisture and air to escape but still prevents the entry of rain, snow or the like.

Figure 2:
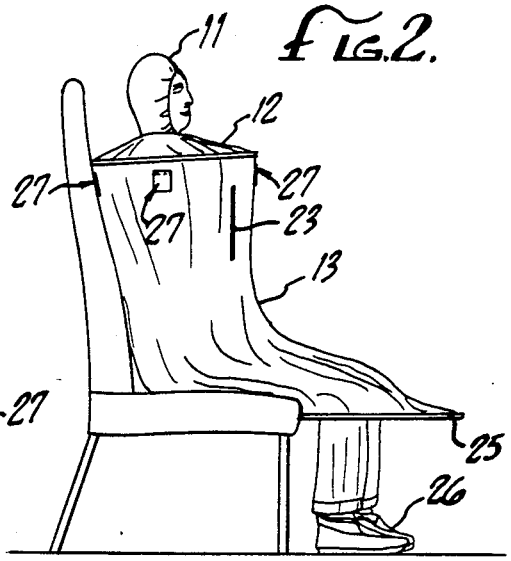
FIG. 2 is a side elevation view of a person wearing the foul weather apparel of this invention in a seated position.

To use the foul weather apparel 10, the person P opens the radial slit 14 in the panel !2 by manipulating the zipper and, with the hood 11 open, places the tubular enclosure 13 over the person's body until the circular panel rests upon the person's shoulders. The dimensions are such that the circular panel 12 engages the shoulders of the person P and supports the tubular enclosure 13 and the circular hoops 17 and 18 even though the hood 11 may be in position on the person's head. The zipper is used to close the radial slit 14 in the circular panel 12 and the drawstring 22 may be used to adjust the size of the face opening 21 in the hood 11. The person P is free to move his or her hands and arms anywhere within the tubular enclosure 13 in both the standing and sitting positions without the need to support any portion of the apparel 10, as is required of an umbrella or a cape, because the tubular enclosure 13 is supported from the circular hoop 17. As shown in FIG. 2, the lower end 25 of the foul weather apparel 10 does not engage the ground when the person sits down, as is true of a long raincoat, because it is supported by the hoop 18. Moreover, the hoop 18 advantageously positions the lower portion of the tubular enclosure 13 over the person's lower legs and shoes 26 to inhibit the amount of rain that might otherwise reach the person's shoes with a normal raincoat or cape. As weather conditions improve, such as the rain stopping, the person can remove the hood and unzip the slit opening 14 for improved air circulation, like a chimney effect, without interfering with the support of the apparel on the shoulders by the circular panel 12. Further, of course, the vertical openings 23 and 24 can be opened for air circulation when the weather conditions improve.

Figure 4A:
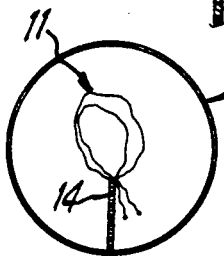
FIGS. 4*a*, 4*b*, 4*c* and 4*d* are diagrammatic illustrations of the folding of the foul weather apparel and the carrying case for compactly storing the foul weather apparel of this invention.
Figure 4B:
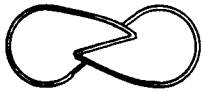
Figure 4C:
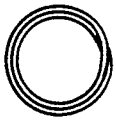
Figure 4D:
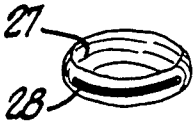

FIGS. 4*a*–4*d* illustrate a convenient manner for folding and storing the foul weather apparel 10 of this invention. FIG. 4*a* is a diagrammatic top view of the foul weather apparel 10 with the tubular enclosure 13 collapsed and the two hoops 17 and 18 together. FIG. 4*b* illustrates an intermediate condition wherein the hoops have been gripped at diametric locations and twisted 180° with respect to each other to form a three dimensional shape having three partially formed loops as a result of the band-shape of the hoop material having much great strength against bending in one direction (vertically in FIG. 3) than in the other direction (horizontally in FIG. 3). By manually twisting and folding the opposite sides of the hoop 17 toward each other with only two hands, the hoop 17 will fold together (such as the left side folding onto the right side as shown in FIG. 4*b*) to form a smaller but triple circle of each of the hoops 17 and 18, as shown in FIG. 4*c*, having a diameter of approximately one-third the diameter of hoop 17 in its unfolded condition. This flat circular combination of material and hoops may then be inserted into a flat circular pouch 27 and enclosed therein by a zipper 28.

While the present invention has been described in connection with a specific embodiment shown in the drawings and described as employing specific elements and materials to form the foul weather apparel 10 in its most desired configuration with certain desirable characteristics, it is to be understood that the invention is not limited to the specific embodiment shown and described but rather is of the full scope of the appended claims.

What is claimed is:

1. A foul weather apparel for a person having a shoulder width of approximately X and a standing height from the ground to the person's shoulder of approximately Y, comprising, a substantially flat circular panel of flexible weather-resistant material having an outside diameter greater than X, said circular panel having an opening in at least the center thereof, a hood of flexible weather-resistant material connected to said circular panel and surrounding said opening, a flexible and substantially circular upper frame having a diameter equal to said outside diameter of said circular panel for maintaining said circular panel substantially flat, a flexible and substantially circular lower frame, a tubular enclosure of flexible weather-resistant material having one circular end connected to said upper frame and circular panel and another circular end connected to said lower frame, said tubular enclosure having a length between said circular ends of less than but a substantial proportion of Y, and the circular panel engaging the person's shoulders when the apparel is being worn for supporting the circular panel, upper and lower frames, and tubular enclosure on the shoulders, said hood being of a height and width to extend upwardly and loosely fit over the person's head without supporting any weight of the rest of the apparel from the person's head when the apparel is being worn by the person.

2. The foul weather apparel of claim 1, wherein said outside diameter of the circular panels is approximately 4 inches larger than X.

3. A foul weather apparel for a person having a shoulder width of approximately X and a standing height from the ground to the person's shoulder of approximately Y, comprising, a substantially flat circular panel of flexible weather-resistant material having an outside diameter greater than X, said circular panel having an opening in at least the center thereof, a hood of flexible weather-resistant material connected to said circular panel and surrounding said opening, a flexible and substantially circular upper frame having a diameter equal to said outside diameter of said circular panel, a flexible and substantially circular lower frame, and a tubular enclosure of flexible weather-resistant material having one circular end connected to said upper frame and circular panel and another circular end connected to said lower frame, said tubular enclosure having a length between said circular ends of less than but a substantial proportion of Y, wherein said circular panel includes a radial slit from said opening adjacent to but spaced from said upper frame and closure means mounted in said radial slit for selectively opening and closing the slit.

4. The foul weather apparel of claim 1, wherein said tubular enclosure includes two openings extending in the direction between the upper and lower frames for use as hand and arm openings and closure means mounted in each of said two openings for selectively opening and closing same.

5. The foul weather apparel of claim 1, wherein said lower frame has a diameter substantially equal to said upper frame diameter.

6. The foul weather apparel of claim 1, wherein said length of the tubular enclosure is approximately between 6 and 12 inches less than Y.

7. The foul weather apparel of claim 1, wherein said hood has a face opening surrounded by a drawstring for adjusting the size of said face opening.

8. A foul weather apparel for a person having a shoulder width of approximately X and a standing height from the ground to the person's shoulder of approximately Y, comprising, a substantially flat circular panel of flexible weather-resistant material having an outside diameter greater than X, said circular panel having an opening in at least the center thereof, a hood of flexible weather-resistant material connected to said circular panel and surrounding said opening, a flexible and substantially circular upper frame having a diameter equal to said outside diameter of said circular panel, a flexible and substantially circular lower frame, and a tubular enclosure of flexible weather-resistant material having one circular and connected to said upper frame and circular panel and another circular end connected to said lower frame, said tubular enclosure having a length between said circular ends of less than but a substantial proportion of Y, wherein said circular panel has a radial slit extending from said opening to a point closely spaced from said upper frame, closure means mounted in said radial slit, and said hood has a face opening aligned with said radial slit.

9. A foul weather apparel for a person having a shoulder width of approximately X and a standing height from the ground to the person's shoulder of approximately Y, comprising, a substantially flat circular panel of flexible weather-resistant material having an outside diameter grater than X, said circular panel having an opening in at least the center thereof, a hood of flexible weather-resistant material connected to said circular panel and surrounding said opening, a flexible and substantially circular upper frame having a diameter equal to said outside diameter of said circular panel, a flexible and substantially circular lower frame, and a tubular enclosure of flexible weather-resistant material having one circular end connected to said upper frame and circular panel and another circular end connected to said lower frame, said tubular enclosure having a length between said circular ends of less than but a substantial proportion of Y, wherein said upper and lower frames each have a band-shaped cross-section with a width substantially larger than a thickness, and said width being oriented perpendicular to the diameter of the frame.

10. A foul weather apparel for a person having a shoulder width of approximately X and a standing height from the ground to the person's shoulder approximately Y, comprising, a flexible circular upper frame having a diameter larger than X, a flexible circular lower frame of substantially the same diameter as the upper frame, said upper and lower frames being substantially parallel and spaced a substantial distance from each other with said distance being less than Y but a substantial portion of Y, a tubular enclosure of flexible weather-resistant material extending between and connected to said upper and lower frames for maintaining a substantially cylindrical shape of said tubular enclosure to surround the person in spaced relationship, a substantially flat circular panel of flexible weather-resistant material having an outside diameter equal to and connected to said upper frame, said circular panel having an opening in the center thereof and a radial slit extending outwardly from said opening for the person's head to pass through said opening and radial slit, a closure means mounted in said radial slit, a hood of flexible weather-resistant material connected to said circular panel and surrounding said opening, said hood having a face opening aligned with said radial slit, and said hood being of a size and shape for loosely accommodating the person's head while said circular panel is supported on the person's shoulders for the circular panel in turn, at least in the person's standing position to support the frames and tubular enclosure.

11. The foul weather apparel of claim 10, wherein said outside diameter of the circular panel is approximately 4 inches larger than X.

12. The foul weather apparel of claim 10, wherein said tubular enclosure includes two openings extending in the direction between the upper and lower frames for use as hand and arm openings and closure means mounted in each of said two openings for selectively opening and closing same.

13. The foul weather apparel of claim 10, wherein said length of the tubular enclosure is approximately between 6 and 12 inches less than Y.

14. The foul weather apparel of claim 10, wherein said face opening on the hood is provided with a drawstring for adjusting the size of said face opening.

15. The foul weather apparel of claim 10, wherein said upper and lower frames each having a band-shaped cross-section with a width substantially larger than a thickness, and said width being oriented perpendicular to the diameter of the frame.

16. A foul weather apparel for a person having a given shoulder width and a given standing height from the ground to the person's shoulder, comprising, a flexible and substantially circular upper frame having a diameter at least approximately equal to said shoulder width, a flexible and substantially circular lower frame substantially parallel to and spaced from said upper frame by a distance less than said standing height but a substantial proportion of said standing height, a tubular enclosure of flexible weather-resistant material extending between and connected to said upper and lower frames for said frames to maintain a substantially cylindrical shape of said tubular enclosure to surround the person, a substantially flat circular panel of flexible weather-resistant material having an outside diameter qual to and connected to said upper frame, said circular panel having an opening in at least the center thereof for the person's head to pass through, and a hood of flexible weather-resistant material connected to said circular panel and surrounding said opening, said upper frame having a diameter and stiffness for maintaining said circular panel substantially flat for said circular panel to engage the person's shoulders when the apparel is being worn, said hood being of a size and shape for extending upwardly from said circular panel and loosely accommodating the person's head while said circular panel is supported on the person's shoulders for said circular panel in turn, at least in the person's standing position, to support the frames and tubular enclosure without the hood supporting any weight of the circular panel, frames or tubular enclosure.

17. A foul weather apparel for a person, comprising a flexible upper frame, a flexible lower frame substantially spaced from said upper frame, a tubular enclosure of flexible weather-resistant material extending between and connected to said upper and lower frames, a substantially flat panel of flexible weather-resistant material having an outer perimeter connected to said upper frame, said panel having an opening at least near a center thereof for the person's head to pass through, and a hod of flexible weather-resistant material connected to said circular panel and surrounding said opening, said upper frame being of a size and stiffness for maintaining said panel substantially flat for the panel to engage the person's shoulders when the apparel is being worn, said hood being of a size and shape for extending upwardly from said flat panel and loosely accommodating the person's head while said panel is supported on the person's shoulders for said panel in turn, at least in the person's standing position, to support the frames and tubular enclosure without the hood supporting any weight of the flat panel, frames or tubular enclosure, said frames being of a size and shape to cause the tubular enclosure, at least in the person's standing position, to be spaced horizontally outwardly from at least a substantial proportion of the person's body to create a thermal-insulating air space around the person within the tubular enclosure.

18. The foul weather apparel of claim 17, wherein said upper and lower frames are circular.

* * * * *

UNITED STATES PATENT AND TRADEMARK OFFICE

CERTIFICATE OF CORRECTION

PATENT NO. : 5,101,513

DATED : April 7, 1992

INVENTOR(S) : Bowers, L.

It is certified that error appears in the above-identified patent and that said Letters Patent is hereby corrected as shown below:

Column 8, line 25 change "hod" to --hood--

Signed and Sealed this

Thirty-first Day of August, 1993

Bruce Lehman

*Attest:*

BRUCE LEHMAN

*Attesting Officer*

*Commissioner of Patents and Trademarks*